United States Patent [19]

Semon

[11] 4,134,585

[45] Jan. 16, 1979

[54] TABLE TENNIS RETURN BOARD

[76] Inventor: Alex Semon, 64-46 211th St., Bayside, N.Y. 11364

[21] Appl. No.: 863,039

[22] Filed: Dec. 21, 1977

Related U.S. Application Data

[63] Continuation of Ser. No. 670,948, Mar. 26, 1976, abandoned.

[51] Int. Cl.[2] ..... A63B 67/04

[52] U.S. Cl. ..... 273/30

[58] Field of Search ..... 272/3; 273/26 R, 26 A, 273/29 R, 29 A, 29 B, 30, 176–182, 1.5 A, 127 R, 102 R

[56] References Cited

U.S. PATENT DOCUMENTS

| | | | |
|---|---|---|---|
| 2,066,159 | 12/1936 | Post | 273/30 |
| 2,161,463 | 6/1939 | Frost | 273/30 |
| 2,162,438 | 6/1939 | Letarte | 273/26 A |
| 2,174,884 | 10/1939 | Kachel | 273/30 |
| 2,247,657 | 7/1941 | Girden | 273/30 |
| 2,333,098 | 11/1943 | Forsyth | 273/30 |
| 3,001,790 | 9/1961 | Pratt | 273/26 A |
| 3,062,544 | 11/1962 | Viets | 273/30 |
| 3,088,735 | 5/1963 | Clark | 273/30 |
| 3,697,068 | 10/1972 | McDougall | 273/29 A |
| 3,814,422 | 6/1974 | Girden | 273/30 |
| 3,968,967 | 7/1976 | Nally | 273/30 X |

FOREIGN PATENT DOCUMENTS

| | | | |
|---|---|---|---|
| 489225 | 7/1938 | United Kingdom | 273/30 |

*Primary Examiner*—Richard J. Apley

[57] ABSTRACT

A table tennis return board for single end table tennis play, consists of a curved three section panel. Each section is covered with a resilient material having, respectively a soft, intermediate or stiff reflective quality. The board may be provided with a plurality of hard reflective disks and a plurality of serrated spin-imparting squares.

5 Claims, 3 Drawing Figures

TABLE TENNIS RETURN BOARD

This is a continuation, of application Ser. No. 670,948, filed Mar. 26, 1976, now abandoned.

BACKGROUND OF THE INVENTION

The invention is in the field of table ball games, more particularly in the field of devices adapted for play from but a single end of the table. A number of such devices are known in the art (See for example, U.S. Pat. No. 2,174,884, Oct. 3, 1939; 3,088,735, May 7, 1963; 3,062,544, Nov. 6, 1962; and 3,814,422, June 4, 1974). One of the objects of some of these devices is to provide for variety in the rebound characteristics so that it will be difficult for the player to predict the placement the ball return. Improvements to this end are desirable in making the game more interesting for the player.

SUMMARY OF THE INVENTION

The disclosed invention is a table tennis return board, which offers variety and unpredictability for play from a single end of the table. The board is a three section curved panel with each section covered by a resilient material with a different degree of stiffness. For added variety a number of hard reflecting members and/or serrated, spin-imparting members can be fixed to the panel.

DETAILED DESCRIPTION OF THE INVENTION

Figure 1:
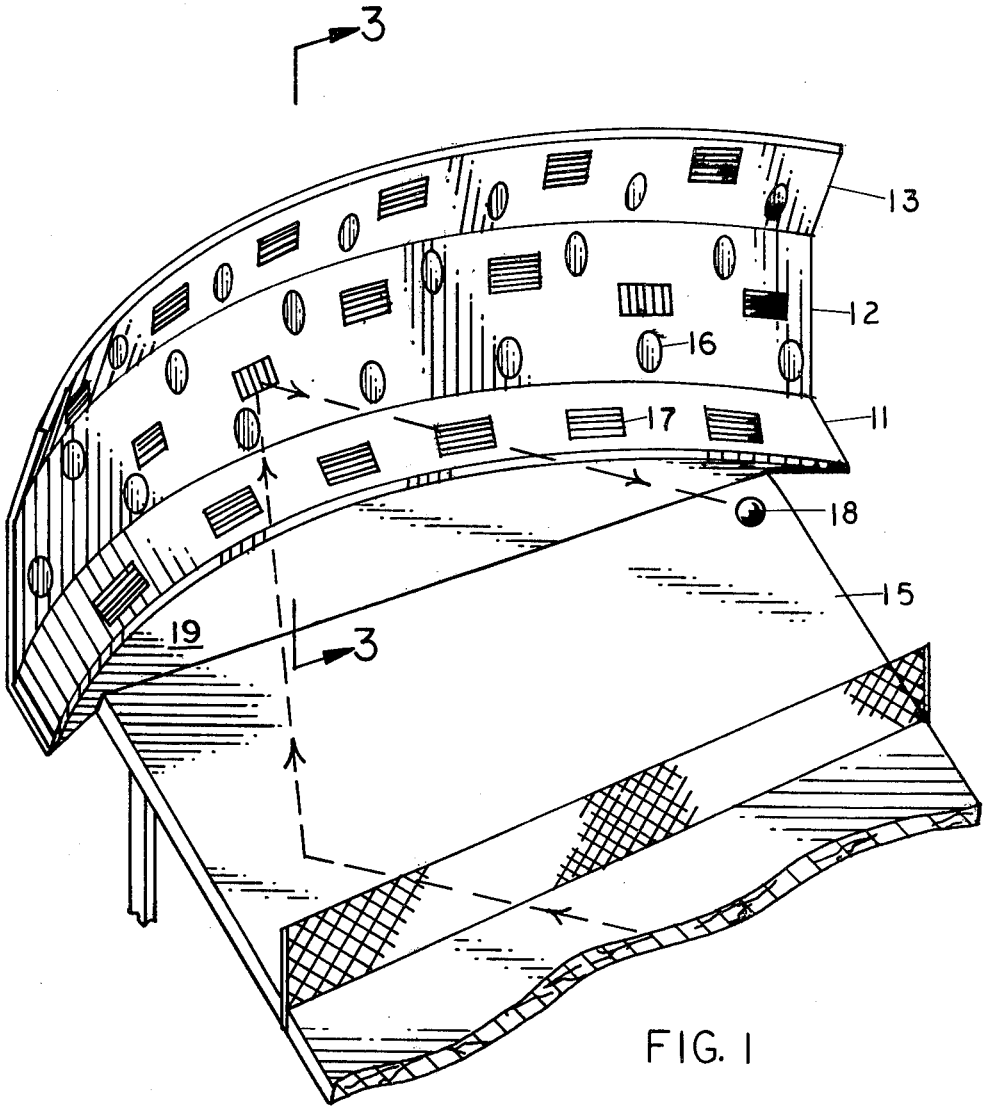
FIG. 1 is a perspective view of a device of the invention affixed to a table tennis table.

The inventive table tennis return board, exemplified in FIG. 1, has a three section curved panel 11, 12, 13 made of a relatively light weight, stiff material, such as aluminum. This panel supports the various reflecting media, which reflect the table tennis ball 18 back to the player or players on the single end of the table, from which the ball is struck. The device also includes a hard apron 19 which serves to extend the table 15 to the panel 11, 12, 13.

Figure 3:
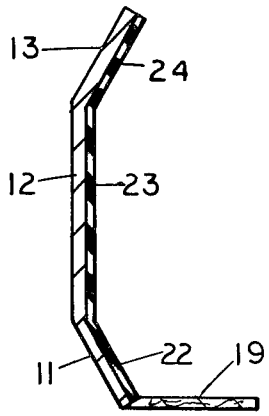
FIG. 3 is an elevational view in section of a device of the invention showing the resilient covering.

As illustrated in FIG. 3, the lower panel 11 is covered with a uniform layer 22 of a soft resilient material (e.g. soft rubber), the upper panel 13 is covered with a harder resilient material 24 (e.g. hard rubber) and the center panel 12 is covered with a material 23 of yield quality intermediate that of the other two materials 22, 24. The lower panel 11 is sloped away from the table 15, the upper panel 13 is sloped toward the table 15 and the center panel 12 is approximately vertical. A curved panel preferably with the radius of curvature of the panel being from the full table length to one half of the table length of this construction will reflect a table tennis ball with a velocity and angle which depends upon the area struck and will result in interesting and active play.

In order to add further variety and unpredictability a number of small deflecting members 16, 17 can be fixed to the panel 11, 12, 13. These can be either flat and hard members 16, preferably disks, or serrated spin imparting members, 17 preferably rectangular or square. The serrated members 17 are arranged to impart a upward, downward, left or right spin with members 17 of various direction, distributed over the panel.

Figure 2:
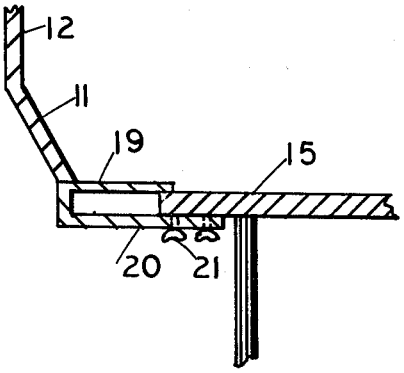
FIG. 2 is an elevational view, in section, of a portion of a device of the invention where it is affixed to a table.

As shown in FIG. 2, the panel 11, 12, 13 may be affixed to the table 15 by means of a clamp 20 and thumb screws 21 in such a manner as to be adjustable. For stronger players the panel can be moved back from the table (as shown in FIG. 2) or the panel can be moved forward toward the table for weaker players.

What is claimed is:

1. A game apparatus, for use in conjunction with a table tennis table, comprising a curved three section rigid panel at least as wide as the table, each section extending the entire width of the table, said panel extending upward of the table and bowed away from the table, and means for affixing the curved panel to the table; wherein when affixed to the table, the lower section of the panel is sloped away from the table and is covered with a soft resilient material; wherein the upper section is sloped toward the table and is covered with a stiff resilient material; and wherein the center section is approximately vertical and is covered with a resilient material of yield quality intermediate that of the upper and lower sections; a said panel further includes a plurality of randomly spaced apart serrated members rigidly affixed to the said panel, wherein said serrated members are adapted for imparting a spin to a striking table-tennis ball.

2. A game apparatus according to claim 1 wherein said panel further includes a plurality of randomly spaced apart flat members of a nonresilient material.

3. A game apparatus according to claim 2 in which the flat members are circular.

4. A game apparatus according to claim 1 in which the serrated members are square.

5. A game apparatus according to claim 1 in which the radius of curvature of the panel is from the full table length to one-half of the table length.

* * * * *